US006926962B2

(12) United States Patent
Yamazaki et al.

(10) Patent No.: US 6,926,962 B2
(45) Date of Patent: Aug. 9, 2005

(54) DYED YARN

(75) Inventors: Hiroshi Yamazaki, Ibaraki (JP); Kazuto Oue, Takatsuki (JP); Mitsuyuki Yamamoto, Kanazawa (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/276,158

(22) PCT Filed: May 17, 2001

(86) PCT No.: PCT/JP01/04173

§ 371 (c)(1),
(2), (4) Date: Nov. 13, 2002

(87) PCT Pub. No.: WO01/88237

PCT Pub. Date: Nov. 22, 2001

(65) Prior Publication Data

US 2003/0167581 A1 Sep. 11, 2003

(30) Foreign Application Priority Data

May 18, 2000 (JP) ..... 2000-146184
Feb. 1, 2001 (JP) ..... 2001-25879

(51) Int. Cl.[7] ..... D02G 3/00; D06M 11/00

(52) U.S. Cl. ..... 428/395; 428/364; 428/375; 428/378; 428/394; 428/369; 428/370; 8/115.6; 8/115.7

(58) Field of Search ..... 428/369, 370, 428/364, 378, 394, 395, 375; 8/115.6, 115.7, 922

(56) References Cited

U.S. PATENT DOCUMENTS

| | | | | | |
|---|---|---|---|---|---|
| 5,782,935 | A | | 7/1998 | Hirt et al. | 8/512 |
| 6,109,015 | A | * | 8/2000 | Roark et al. | 57/290 |
| 6,284,370 | B1 | * | 9/2001 | Fujimoto et al. | 428/364 |
| 6,335,093 | B1 | * | 1/2002 | Mori et al. | 428/370 |
| 6,620,502 | B1 | * | 9/2003 | Fujimoto et al. | 428/357 |
| 2003/0059611 | A1 | * | 3/2003 | Koyanagi et al. | 428/373 |
| 2003/0065105 | A1 | * | 4/2003 | Kato et al. | 525/418 |
| 2003/0167581 | A1 | * | 9/2003 | Yamazaki et al. | 8/536 |

FOREIGN PATENT DOCUMENTS

| | | | | | |
|---|---|---|---|---|---|
| EP | 1288356 | A1 | * | 3/2003 | D02G/3/32 |
| JP | 08170238 | A | | 7/1996 | |
| JP | 11012902 | A | | 1/1999 | |
| JP | 11-107038 | | | 4/1999 | |
| WO | WO99/27168 | | | 6/1999 | |
| WO | WO 00/73553 | A1 | | 12/2000 | |
| WO | WO 01/04393 | A1 | * | 1/2001 | |
| WO | WO 01/23654 | A1 | | 5/2001 | |
| WO | WO 01/88237 | A1 | * | 11/2001 | |

* cited by examiner

*Primary Examiner*—Rena Dye
*Assistant Examiner*—J. M. Gray
(74) *Attorney, Agent, or Firm*—Finnegan, Henderson, Farabow, Garrett & Dunner, L.L.P.

(57) ABSTRACT

The invention provides dyed yarn characterized by comprising dyed polytrimethylene terephthalate fiber, having an elastic recovery of 60% or greater under 10% elongation, and having a boiling water shrinkage of no greater than 4%. The dyed yarn of the invention has excellent stretchability and dimensional stability as well as a soft feel, and is therefore suitable for use in fabrics.

4 Claims, No Drawings

DYED YARN

TECHNICAL FIELD

The present invention relates to dyed yarn composed of polytrimethylene terephthalate fiber.

BACKGROUND ART

Polytrimethylene terephthalate fiber, which exhibits the pliability of nylon fiber and the mechanical properties of polyester fiber, is a fiber used for clothing applications because of its characteristically excellent stretchability (easy elongation and easy recovery after stretching).

Currently in the field of clothing manufacture, fabrics (hereinafter, a fabric includes a woven fabric and a knitted fabric) composed of polytrimethylene terephthalate fiber are subjected to "fabric dyeing", which is dyeing of the fabric, in order to obtain fabrics with an excellent soft feel and stretchability.

Fabric dyeing, however, has had a drawback in that it cannot produce fabrics with an excellent fashionable sort of high-quality, which are instead obtained by forming patterns through color arrangements between yarns. This has led to increased demand for fabrics made of dyed yarn, with the fabrics being woven or knitted by the yarn after dyeing; however, dyed yarn exhibiting the original soft feel and stretchability of polytrimethylene terephthalate fiber and excellent dimensional stability suitable for fabric purposes has not yet been achieved.

With fabric dyeing, fabrics exhibiting excellent stretchability and excellent bulkiness can be obtained using polytrimethylene terephthalate fiber crimped by yarn working such as false twisting. However, the crimp elongation is insufficient when using dyed yarn obtained by ordinary methods that employ polytrimethylene terephthalate fabric crimped by yarn working such as false twisting, and when such yarn is used for fabrics, the resulting fabrics have inferior stretchability and bulkiness compared to fabrics obtained by fabric dyeing. For this reason there has been a demand for dyed yarn with high crimp elongation, which can provide fabrics having excellent stretchability and bulkiness.

On the other hand, cellulose-based fiber and wool fiber both have excellent moisture absorption and a characteristic feel, and are therefore in high demand for dyed yarn. Nevertheless, when cellulose-based fiber or wool fiber is used alone in fabrics, the dimensional stability is inferior and wrinkles tend to develop.

In order to solve such problems, Japanese Unexamined Patent Publication (Kokai HEI) No. 8-170238 and other publications have proposed combining regenerated cellulose fiber and polyester fiber. However, while combination with polyester fiber improves the dimensional stability and wrinkle resistance, a harder feel tends to result, or else the feel becomes that of polyester, thereby significantly impairing the feel of the cellulose-based fiber or wool fiber, while the stretchability is also inadequate.

A demand has therefore existed for dyed yarn exhibiting the feel of cellulose-based fiber or wool fiber, while also having excellent stretchability and dimensional stability.

DISCLOSURE OF THE INVENTION

The present invention is as follows.

1. Dyed yarn characterized by comprising dyed polytrimethylene terephthalate fiber, having an elastic recovery of 60% or greater under 10% elongation, and having a boiling water shrinkage of no greater than 4%.

2. Dyed yarn according to 1. above, characterized in that the yarn is crimped yarn with a crimp elongation of 10% or greater.

3. Dyed yarn according to 1. or 2. above, characterized in that the yarn is composed of polytrimethylene terephthalate fiber and a fiber other than polytrimethylene terephthalate fiber.

4. Dyed yarn according to 3. above, characterized in that the fiber other than polytrimethylene terephthalate fiber is cellulose-based fiber or wool fiber.

5. Dyed yarn according to any one of 1. to 4. above, characterized in that the yarn has an elongation of 5% or greater under a load of 0.8826 cN/dtex.

DETAILED DESCRIPTION OF THE INVENTION

The objects of the invention are listed below as (1), (2) and (3).

(1) To provide dyed yarn of polytrimethylene terephthalate fiber with excellent stretchability and dimensional stability and capable of forming fabrics with a soft feel.

(2) To provide dyed yarn with higher crimp elongation for crimped dyed yarn, which allows formation of fabrics with excellent bulkiness.

(3) To provide dyed yarn which allows formation of fabrics without impairing the feel of cellulose-based fiber or wool fiber when used in mixed yarns with cellulose-based fiber or wool fiber.

As a result of diligent research on these problems, the present inventors have accomplished the present invention upon finding that these problems can be overcome by employing a specific dyeing method for dyeing of yarn composed of polytrimethylene terephthalate fiber.

The present invention will now be explained in greater detail.

According to the invention, "polytrimethylene terephthalate fiber" refers to polyester fiber wherein the primary repeating unit is a trimethylene terephthalate unit, and wherein the trimethylene terephthalate unit content is at least about 50 mole percent, preferably at least 70 mole percent, more preferably at least 80 mole percent and even more preferably at least 90 mole percent.

It therefore includes polytrimethylene terephthalate containing another acid component and/or glycol component as a third component, in a total amount of no greater than about 50 mole percent, preferably no greater than 30 mole percent, more preferably no greater than 20 mole percent and even more preferably no greater than 10 mole percent.

Polytrimethylene terephthalate is synthesized by bonding terephthalic acid or a functional derivative thereof with trimethylene glycol or a functional derivative thereof, under appropriate reaction conditions in the presence of a catalyst. In the synthesis process, one or more types of appropriate third components may be added to prepare a polyester copolymer, or the polytrimethylene terephthalate may be blended with nylon or a polyester other than polytrimethylene terephthalate such as polyethylene terephthalate, for composite spinning (sheath-core, side-by-side, etc.)

Composite spinning, as exemplified in Japanese Examined Patent Publication SHO No. 43-19108, Japanese Unexamined Patent Publication HEI No. 11-189923, Japanese Unexamined Patent Publication No. 2000-239927 or Japanese Unexamined Patent Publication No. 2000-256918, using polytrimethylene terephthalate as a first component and using nylon or a polyester such as polytrimethylene terephthalate, polyethylene terephthalate or polybutylene terephthalate as a second component, involves side-by-side or eccentric sheath-core composite spinning wherein the first and second components are arranged in parallel or eccentrically.

Preferred are combinations of polytrimethylene terephthalate and polytrimethylene terephthalate copolymer, or combinations of two types of polytrimethylene terephthalate with different intrinsic viscosities. It is particularly preferred to use two types of polytrimethylene terephthalate with different intrinsic viscosities, for side-by-side composite spinning in which the lower viscosity component surrounds the higher viscosity component with a curved bonding surface, as disclosed in Japanese Unexamined Patent Publication No. 2000-239927, since this combines the advantages of high stretchability and high bulk.

As third components to be added there may be mentioned aliphatic dicarboxylic acids (oxalic acid, adipic acid, etc.), alicyclic dicarboxylic acids (cyclohexanedicarboxylic acid, etc.), aromatic dicarboxylic acids (isophthalic acid, sodium-sulfoisophthalic acid, etc.), aliphatic glycols (ethylene glycol, 1,2-propylene glycol, tetramethylene glycol, etc.), alicyclic glycols (cyclohexanedimethanol, etc.), aliphatic glycols containing aromatic rings (1,4-bis(β-hydroxyethoxy)benzene, etc.), polyether glycols (polyethylene glycol, polypropylene glycol, etc.), aliphatic oxycarboxylic acids (ω-oxycaproic acid, etc.) and aromatic oxycarboxylic acids (p-oxybenzoic acid, etc.).

Compounds having 1 or 3 or more ester-forming functional groups (benzoic acid, etc. or glycerin, etc.) may also be used so long as the polymer is essentially linear.

There may also be added delustering agents such as titanium dioxide, stabilizers such as phosphoric acid, bluing agents such as cobalt acetate, ultraviolet absorbers such as hydroxbenzophenone derivatives, crystallization nucleating agents such as talc, lubricants such as aerosil, antioxidants such as hindered phenol derivatives, flame retardants, electrostatic agents, pigments, fluorescent whiteners, infrared absorbers, defoaming agents, and the like.

According to the invention, spinning of the polytrimethylene terephthalate fiber may be accomplished by any method, for example, a method of obtaining undrawn yarn at a take-up speed of about 1500 m/min and then draw-twisting at a factor of about 2–3.5, a direct drawing method with an on-line spinning/draw-twisting step (spin-draw method), a high-speed spinning method with a take-up speed of 5000 m/min or greater (spin/take-up method), or a method of drawing subsequent to cooling in a water bath after spinning.

The fiber may be filament or short fiber. Also, the fiber shape may be uniform or irregular in thickness in the lengthwise direction, and the cross-sectional shape of the fiber may be circular, triangular, L-shaped, T-shaped, Y-shaped, W-shaped, eight leaf-shaped, flat-shaped, polygonal such as dog bone-shaped, multi-lobed, hollow or indefinitely shaped.

Further, the yarn is preferably produced yarn, false twisted yarn (including POY drawn false twisted yarn), pretwisted-false twisted yarn (for example, pretwisted 600–1000 T/m in the S or Z direction and false twisted 3000–4000 T/m in the Z or S direction), air-jet textured yarn, spun yarn such as ring-spun yarn, open-end spun yarn or the like, multifilament produced yarn (including superfine yarn) or blended yarns.

The undyed polytrimethylene terephthalate fiber used for the invention preferably has a breaking strength of 2.2–4.0 cN/dtex, a breaking elongation of 30–55%, a Young's modulus of 14–24 cN/dtex, an elastic recovery of 60–95% under 20% elongation and a boiling water shrinkage of 4–20%.

The total size of fiber is preferably 20–550 dtex and more preferably 30–220 dtex, while the single filament size is preferably 0.1–12 dtex and especially 0.5–5 dtex, in order to give a soft feel.

The yarn of the invention is sufficient if it comprises polytrimethylene terephthalate fiber. It preferably comprises the polytrimethylene terephthalate fiber in an amount of at least 20 wt %, more preferably at least 30 wt % and even more preferably at least 50 wt %. Fabrics with satisfactory stretchability can be obtained if the amount is at least 20 wt %.

The fiber other than the polytrimethylene terephthalate fiber composing the yarn of the invention may be any fiber including natural fiber such as wool, cotton, hemp or silk, regenerated cellulose fiber such as viscose rayon or cupro, or synthetic fiber represented by acetate, polyethylene terephthalate, polyamide and acryl.

The dyed yarn of the invention has an elastic recovery of 60% or more under 10% elongation, preferably from 60 to 95%, more preferably from 70 to 95%. If an elastic recovery under 10% elongation is 60% or more, a fabric having excellent stretchability can be obtained. In general, a yarn having an elastic recovery of more than 95% under 10% elongation can hardly be obtained.

The dyed yarn of the invention has a boiling water shrinkage of no greater than 4%, more preferably no greater than 3% and most preferably no greater than 2%. The boiling water shrinkage is the value measured according to boiling water shrinkage measurement method B of JIS-L-1013, at a hot water temperature of 100° C. A boiling water shrinkage of 4% or less will ensure virtually no change in the property of the gray fabric and property of the finished fabric and will result in virtually no shrinkage or stretching when the fabric is washed, thereby yielding a product with excellent dimensional stability.

"Dyed yarn" according to the invention refers to yarn which has been dyed while in a hank or cheese state, and especially yarn which may be suitably used for fabrics. It does not include yarn detached from a dyed woven or knitted fabric.

In order to obtain dyed yarn according to the invention it is preferred to accomplish yarn dyeing by cheese dyeing or hank dyeing.

The following description concerns cheese dyeing.

The cheese winding density is preferably 0.1–0.5 g/cm$^3$, and more preferably 0.25–0.4 g/cm$^3$. A winding density of greater than 0.1 g/cm$^3$ will give a stable cheese state, so that for dyeing after setting in a cheese dyeing machine, the form will not disintegrate, the yarn will relax in a uniform manner, and the dyeing solution will pass through evenly for uniform dyeing. A winding density of no greater than 0.5 g/cm$^3$ will prevent an excessive cheese winding density even when the yarn undergoes thermal contraction during scouring and dyeing, thereby ensuring satisfactory passage of the dye solution, avoiding production of uneven dyeing in the inner and outer layers of the cheese, and keeping the boiling water shrinkage from becoming too high.

In order to obtain a level dyeing property with cheese dyeing, it is preferred not only for the cheese winding density to be 0.1–0.50 g/cm$^3$, but also to employ a method in which after soft winding on a paper tube, the paper tube is replaced with a dyeing tube with a smaller outer diameter for cheese dyeing, to prevent increased winding density of the cheese by thread shrinkage during dyeing. The replacement rate with the dyeing tube is in the range of preferably 5–30% and more preferably 10–20%, and may be appropriately set with consideration of the yarn thread shrinkage. The replacement rate (%) is the value determined by the following equation, where A is the outer diameter of the winding paper tube and B is the outer diameter of the dyeing tube.

$$\text{Replacement rate } (\%)=(1-B/A)\times 100$$

The cheese dyeing may be accomplished with a commonly used cheese dyeing machine. Scouring may be carried out under conditions for washing of produced yarn oiling agents, as is commonly practiced, and for example, it may be carried out for 10–30 minutes at 50–90° C. in the presence of a nonionic surfactant, sodium carbonate, or the like.

The polytrimethylene terephthalate fiber may be dyed according to a dyeing method employing a disperse dye, as is common for polyethylene terephthalate fiber. For example, the dyeing temperature may be 90–130° C. and the dyeing period from 15–120 minutes, but because of the low glass transition temperature of polytrimethylene terephthalate fiber, even with dyeing at low temperatures of 90–120° C. it can characteristically exhibit coloration which is superior to conventional polyethylene terephthalate fiber.

When the yarn also comprises fiber other than polytrimethylene terephthalate, the dyeing conditions may be adjusted for normal dyeing of such fiber, and it may be dyed either before, after or during dyeing of the polytrimethylene terephthalate fiber.

According to the invention, a common commercially available oiling agent or the like may be added to the cheese form or yarn in order to improve the knitting ability and pliability of the yarn.

The following description concerns hank dyeing.

Hank dyeing may be carried out by employing common steps, which are usually hank reeling→pretreatment→scouring→dyeing→dewatering→drying→cone winding.

The hank reeling may be carried out using a common hank reeler, preferably to prepare a hank of 50 g to 2 kg with a hank length of 1–3 m.

In order to relax the hank as pretreatment, an air drier, continuous hank heat treatment apparatus or the like may be used for dry heat treatment at preferably 50–100° C. and more preferably 60–90° C. for a period of 5–30 minutes. An autoclave, steam setter, steam box, etc. may also be used for steam treatment at preferably 60–130° C. and more preferably 80–110° C. for a period of 5–30 minutes.

Scouring and dyeing may be accomplished with appropriate selection of a circulation type hank dyeing machine, spray type hank dyeing machine, package dyeing machine or the like. The scouring may be carried out under conditions for washing of produced yarn oiling agents, as is commonly practiced, and for example, it may be carried out for 10–30 minutes at 50–90° C. in the presence of a nonionic surfactant, sodium carbonate, or the like.

The polytrimethylene terephthalate fiber may be dyed according to a dyeing method employing a disperse dye, as is common for polyethylene terephthalate fiber. For example, the dyeing temperature may be 90–130° C. and the dyeing period from 15–120 minutes. When the yarn also comprises fiber other than polytrimethylene terephthalate, the dyeing conditions may be adjusted for normal dyeing of such fiber, and it may be dyed either before, after or during dyeing of the polytrimethylene terephthalate fiber.

The dewatering and drying steps may be carried out according to common methods.

Cone winding may be accomplished by winding using a common winding machine, but unstable winding tension from the hank can produce warp streaks or weft bars when the fabric is formed, and it is therefore preferred to rewind back onto another cone after winding from the hank to the cone, or to carry out cone winding with a feed roller-equipped winding machine to allow control of the winding tension.

A common commercially available oiling agent or the like may be added to the hank form or during cone winding in order to improve the knitting ability and pliability of the yarn.

Polytrimethylene terephthalate fiber has more oligomers than polyethylene terephthalate fiber, and adhesion of those oligomers can reduce the gloss of the dyed yarn. An alkali agent may therefore be used in the scouring step (for example adding 0.5–5 g/liter of sodium carbonate or sodium hydroxide), or dyeing may be carried out at the alkali end of pH 8–11 with an alkali-resistant disperse dye, in order to reduce oligomer adhesion. Here, the waste water is preferably at the same high temperature as the scouring and dyeing temperature.

The dyed yarn of the invention has a crimp elongation of at least 10%, more preferably 15–500%, even more preferably 20–300% and most preferably 5–150%. A crimp elongation within this range will yield a fabric with excellent stretchability and bulkiness.

The yarn is composed of crimped yarn of polytrimethylene terephthalate fiber.

Examples of crimped yarn include composite fiber yarn with developed crimping and/or latent crimping (composite produced yarn such as sheath-core or side-by-side), or yarn which has been crimped by false twisting, stuffer-box crimping or knit-de-knit texturing.

As a property of the crimped yarn, the crimp elongation is preferably at least 10%, more preferably at least 20% even more preferably at least 50%. By using yarn with a crimp elongation in this range, it is possible to obtain dyed yarn with a crimp elongation of 10% or greater. The "crimp elongation" referred to here is the value measured according to stretchability test method A of JIS-L-1090 after treatment with dry heat at 90° C. for 15 minutes under a load of $2.6\times10^{-4}$ cN/dtex, and standing for 24 hours.

The crimped yarn is most preferably false twisted yarn which readily exhibits a high crimp elongation. The false twisting may be based on a commonly used pin-type, friction-type, nip-belt type or air-twisting type process. It may be single-heater false twisting or double-heater false twisting, and it may even be POY draw twisting.

The false twisting heater temperature may be set as desired within a range which allows the object of the invention to be achieved, and in most cases the yarn temperature immediately at the exit port of the first heater will be in the range of preferably 100° C. to 200° C., more preferably 120° C. to 180° C. and most preferably 130° C. to 170° C.

If necessary, the yarn may be heat set at a second heater to obtain double-heater false twisted yarn. The second heater temperature is preferably 100° C. to 210° C., and more preferably it is in the range of no lower than 30° C. below and no higher than 50° C. above the yarn temperature immediately at the exit port of the first heater. The overfeed ratio in the second heater (second overfeed ratio) is preferably from +3% to +30%.

The number of false twists T may be in a range commonly used for false twisting of polyethylene terephthalate-based polyester fiber, and it is calculated by the equation shown below. In this case, the value of the false twisting constant K is preferably in the range of 17,600 to 35,000, and the preferred number of false twists T is determined based on the false twisted yarn.

$$T(T/m)=K/\{\text{size of false twisted yarn (dtex)}\}^{0.5}$$

As another type of preferred crimped yarn, it is preferred to use composite fiber with developed crimping and/or latent crimping wherein two types of polytrimethylene terephthalate with different intrinsic viscosities are employed in side-by-side composite spinning in which the lower viscosity component surrounds the higher viscosity component with a curved bonding surface, because this not only makes it possible to obtain dyed yarn with the same high degree of crimping as false twisted yarn, but also facilitates handling of the hank during the hank dyeing step, since none of the residual torque typical of false twisted yarn is present. A cost advantage is also achieved since the crimping step can be omitted.

The crimped yarn may also be blended with other types of fiber, for example, natural fiber such as wool, or other fiber (also including polytrimethylene terephthalate filament yarn and short fiber), at normally no greater than 80 wt %, preferably no greater than 70 wt % and more preferably no greater than 50 wt %, by means such as mix spinning (CSIRO fil., etc.), interlaced blended fiber (high-shrinkage fiber and different shrinkage blended yarn, etc.), yarn doubling and composite false twisting (elongation-based false twisting), two-feed fluid-jet texturing, and the like, so long as the object of the invention is not impeded.

In order to improve the processability during the cheese or hank dyeing step, one or two or more crimped filaments (in the case of false twisting, the false twisting directions may be either in the same direction or in different directions) may be combined for twisting (additional twisting) at 50–1000 T/m and preferably 50–300 T/m. It is preferred to conduct additional twisting within this range in order to avoid almost all tangling between the filaments and particularly in the case of hank dyeing, to reduce breakage during the step of cone winding from the dyed hank.

When using false twisted yarn which has been false twisted in only one direction, the yarn twisting is preferably carried out in the opposite direction from the false twisting in order to increase the crimp elongation of the dyed yarn. There are no particular restrictions on the yarn twisting machine, and an Italy yarn twister, ring yarn twister, double twister or the like may be used.

Since polyester fiber or polyamide fiber which is yarn twisted usually generates torque in the direction opposite to the direction of yarn twisting, it is commonly twist set after yarn twisting to relieve the torque. Polytrimethylene terephthalate fiber, however, is characterized by being resistant to relief of torque. This is due to the high heat shrinkage of polytrimethylene terephthalate fiber, wherein contraction of the non-crystalline sections occurs upon twist setting in a state of tension, with the shrinkage stress causing the crystalline sections to elongate. Because they are almost completely elastic, the crystalline sections do not relieve the torque even upon twist setting. It is surmised that this is the reason that only high residual torque yarn is obtained as a result.

Since polytrimethylene terephthalate fiber is pliable, the use of high residual torque yarn for production of hank results in local concentration of torque which produces snarls (a phenomenon of local twisting of the yarn) at those points, and it has been shown that these snarls cause the yarns to tangle together, resulting in poor yarn separability.

The present inventors have found that in the case of polytrimethylene terephthalate fiber, a yarn twist number of less than 300 T/m causes the torque to be absorbed by the filaments composing the yarn even if the hank is prepared without twist setting, such that there is no local concentration of torque and the resulting hank contains virtually no snarls.

In other words, in order to obtain dyed yarn with a crimp elongation property of 10% or greater it is preferred to omit the twist setting step.

However, in cases with such a large number of twists that the torque absolutely must be relieved by twist setting, twist setting may be carried out so long as the object of the invention can still be achieved. In such cases, the polytrimethylene terephthalate fiber is preferably subjected to twist setting while relaxing the yarn, since twist setting is less effective in a state of tension. For example, rewinding may be carried out around a cardboard dummy cushion material in the inner layer of an aluminum flanged cylinder in order to accomplish twist setting while adequately relaxing the yarn. The winding amount is not important so long as it is sufficient to prevent loss of the wound shape by setting in the yarn cylinder winding. Winding at a tension of no greater than 0.1 cN/dtex is preferred for a sufficient effect by setting.

An apparatus such as a vacuum setter can usually be used for setting. From the standpoint of achieving an adequate setting effect and crimping expression, as well as energy efficiency, the treatment temperature is preferably 60–110° C. and the treatment time is usually preferred to be 10–60 minutes.

The crimped yarn may also be subjected to bulking before or after yarn twisting in order to develop the latent crimping in the yarn for increased crimping. This is particularly effective for cheese dyeing, since the crimped yarn sometimes cannot be sufficiently relaxed during dyeing. The apparatus used for bulking may be, for example, a Bulone by Sakamoto Rensen Co., Ltd., or a continuous bulking apparatus by Superba Co.

The working may be carried out under conditions with an overfeed ratio of 50–200%, using dry heat or steam as the heat source for relaxation with treatment at preferably 60–200° C. and more preferably 90–190° C. The bulked yarn will have a boiling water shrinkage of 4% or lower and a crimp elongation of 50% or greater. This gives dyed yarn with a high crimp elongation, since only slight yarn shrinkage occurs during cheese dyeing and the crimps are not elongated with shrinkage.

A method of obtaining yarn with the specific crimp elongation of the invention will now be explained.

In the case of hank dyeing, it may be carried out according to the dyeing method described above, but the hank is preferably relaxed by dry or wet heating (with steam or hot water) during pretreatment or in the scouring and dyeing steps (to express the crimps with as little tension as possible).

For example, when the hank is relaxed by pretreatment, a hot air drier or continuous hank heat treatment apparatus may be used for dry heat treatment at preferably 50–100° C. and more preferably 60–90° C., for a period of 5–30 minutes. An autoclave, steam setter, steam box or the like may also be used for steam treatment at preferably 60–130° C. and more preferably 80–110° C. for a period of 5–30 minutes. However, if the pretreatment is carried out with the hank anchored in a frame or with the hank stuffed in a bag at high density, so that the hank itself is restricted, it may not be possible to adequately express crimping in some cases.

On the other hand, when the hank is relaxed in the scouring and dyeing steps, it is preferably subjected to hot water treatment for 5–60 minutes at 50–130° C. using a circulation type hank dyeing machine or spray tape hank dyeing machine, to minimize tension on the hank. Some spray type hank dyeing machines are provided with a vertical anchoring bar for adjustment of the hank length, and with such apparatuses it is preferred to narrow the anchoring bar as much as possible to allow relaxation of the hank during treatment.

In the case of cheese dyeing, it may be carried out by the dyeing method described above, but crimped yarn which has been bulked to express its latent crimping is preferably used in order to obtain dyed yarn with a high crimp elongation.

The yarn of the invention is preferably a yarn blended with natural cellulose fiber such as cotton or hemp, regenerated cellulose fiber such as cupro, viscose rayon or polynosic rayon, cellulose-based fiber such as riocell (direct spun cellulose fiber) or wool fiber such as wool, alpaca, mohair, angora, camel or cashmere, in order to effectively take advantage of the feel of cellulose-based fiber or wool fiber, and to obtain dyed yarn with excellent dimensional stability and stretchability.

Also, blends with multifilaments of regenerated cellulose fiber such as cupro or viscose rayon are preferred for fabrics in order to obtain the lustrous feel of the regenerated cellulose fiber multifilaments, and in particular, blending of regenerated cellulose fiber multifilaments with a boiling water shrinkage of from −3 to 5% is preferred because this results in a greater difference in shrinkage with the polytrimethylene terephthalate fiber in the dyeing, so that the cellulose feel is not lost and the stretchability may be more readily exhibited.

There are no particular restrictions on the method of spinning the regenerated cellulose fiber, and it may be fiber produced by any method such as a hank method, cake method, net process method or roving method; however, a hank method, cake method or net process method is preferred to obtain regenerated cellulose fiber multifilaments with a boiling water shrinkage of from −3 to 5%.

Also, two or more different types of such yarn may be combined and doubled, or interlaced, and depending on the purpose of use, a delustering agent such as titanium oxide or any of various publicly known additives may also be included.

Cellulose-based fiber or wool fiber with a single filament size of preferably 0.1–12 dtex and more preferably 1–5 dtex may be blended with the polytrimethylene terephthalate fiber for more excellent processability and a more soft yarn feel.

According to the invention, the method of blending the polytrimethylene terephthalate fiber and other fiber may be any method that can integrate the different fibers, and is otherwise not particularly restricted; for example, they may be blended by means such as yarn doubling, covering, false twisting, fluid-jet texturing or combined spun spinning. When the yarn comprises a sheath-core structure such as obtained by covering, elongation-based false twisting or two-feed fluid-jet texturing, using the polytrimethylene terephthalate fiber as the core yarn is preferred to obtain superior stretchability.

In the case of false twisting, a belt-nip, friction or pin type false twisting machine may be used, and the false twisting temperature is preferably 140–180° C. in consideration of the melting point of polytrimethylene terephthalate fiber. The false twisted yarn may also be subjected to additional twisting at 50–1000 T/m for an improved bundling property. For improved stretchability, the direction for additional twisting is preferably in the direction opposite from the false twisting direction.

In the case of yarn doubling, there are no particular restrictions on the number of doubled filaments, the number of twists or the direction of yarn twisting, but for yarn twisting with a first twist and second twist it is preferred to balance the twisting so that no residual torque remains in the plied yarn, and in the case of two folded yarn twisting, for example, the ratio of the number of second twists with respect to each first twist is preferably 0.6–0.8, in order to minimize opening of the twist. The yarn twisting may involve, for example, plied yarn of two strands of double twisted yarn in which polytrimethylene terephthalate fiber and another fiber are first twisted.

In the case of covering, there are no particular restrictions on the number of covering strands, the number of coverings and the covering direction, but when false twisted yarn of polytrimethylene terephthalate fiber is used as the covering yarn for double covering, it is preferred to use false twisted yarn with a different false twisting direction in order to alleviate residual torque of the covering yarn.

As a method for blending yarn of cellulose-based fiber or wool fiber with polytrimethylene terephthalate fiber, there may be employed, for example, a method of double twisting the polytrimethylene terephthalate fiber with the cellulose-based fiber or wool fiber, a covering method using the polytrimethylene terephthalate fiber as the core and winding the cellulose-based fiber or wool fiber around it, a method of fluid-jet texturing using the polytrimethylene terephthalate fiber as the core yarn and the cellulose-based fiber or wool fiber as the sheath yarn, a method of doubling the polytrimethylene terephthalate fiber and the cellulose-based fiber or wool fiber and false twisting it, or a method of interlacing the polytrimethylene telephthalate fiber and the cellulose-based fiber or wool fiber with an interlace nozzle either before or after the false twisting step. In the case of cotton or wool staple fibers, the method may involve combined spun spinning them as a blend with polytrimethylene terephthalate fiber at the spinning process.

In these blending methods, the polytrimethylene terephthalate fiber is preferably stretched by about 1–5% while it is blended with the cellulose-based fiber or wool fiber, in order to improve the stretchability of the yarn. The constitutive proportion of the cellulose-based fiber or wool fiber with respect to the polytrimethylene terephthalate fiber is preferably 80:20 to 20:80 and more preferably 70:30 to 40:60 in terms of weight ratio. If the constitutive proportion of the cellulose-based fiber or wool fiber is within this range, the dimensional stability and stretchability will be excellent and the feel of the cellulose-based fiber or wool fiber will be effectively exhibited.

The dyed yarn of the invention has an elongation of preferably between 5% and 50% and more preferably between 10% and 30%, under a load of 0.8826 cN/dtex. If this range is satisfied, the dyed yarn will exhibit suitable stretchability and no yarn breakage will occur during knitting or weaving. Particularly in the case of dyed yarn which is a composite with cellulose-based fiber or wool fiber, the cellulose-based fiber or wool fiber becomes the sheath and the polytrimethylene terephthalate fiber becomes the core, so that the produced dyed yarn effectively exhibits the feel of cellulose-based fiber or wool fiber.

When the elongation is greater than 20% under a load of 0.8826 cN/dtex, the blended fiber takes the form of relaxed, low integrated composite yarn, and therefore in order to improve the surface quality of the fabric it is preferred to subject the dyed composite yarn to additional twisting at 50–1000 T/m.

According to a preferred representative mode of the invention, regenerated cellulose filaments and polytrimethylene terephthalate filaments are blended at a weight ratio of 30:70 to 60:40, either by covering with the false twisted polytrimethylene terephthalate filament yarn as the core yarn and the regenerated cellulose filaments as the winding yarn, or with interlaced doubling of the regenerated cellulose filaments and polytrimethylene terephthalate filaments, followed by false twisting, and then the obtained yarn is formed into a cheese with a winding density of 0.1–0.5 g/cm$^3$ and cheese dyed at a replacement rate of 10–20% onto the dyeing tube. Alternatively, a hank is prepared and hank dyeing is carried out with a spray type hank dyeing machine.

The dyed yarn of the invention is preferably at least 500 m, and more preferably at least 1000 m, of continuous yarn with no knotting. Such yarn can provide defect-free fabric body which presents no troubles such as yarn breakage during knitting or weaving of fabrics.

The dyed yarn of the invention preferably has no more 5 crimps and more preferably no more than 1 crimp, with a radius of 2 mm or greater, per 2.54 cm. A number of crimps within this range will ensure excellent surface quality of the fabric. The number of crimps generally exceeds 5 in yarn which is not dyed yarn according to the invention but rather yarn which has been made into a fabric, dyed and then removed after decomposing the fabric.

The number of crimps is measured according to the crimp counting method of JIS-L-1015, wherein the number of crimps is examined in a 2.54 cm section under an initial load of 0.18 mN/dtex on the entire dyed yarn, and the crimps with a radius of 2 mm or greater are counted. The crimps are counted at 10 random points in the yarn length direction, and the average value is calculated.

The dyed yarn of the invention may be used in woven fabrics (taffeta, twill, satin or various modified textures) or knitted fabrics (warp knits, circular knits, weft knits, pantstocking knits, etc.), or it may be used for the surface of a carpet (erected yarn). A particular advantage is provided for usage as weft knitting yarn, since the obtained weft knit fabric can be easily set by Hoffman press finishing. The texture of the knitted fabric may be plain stitch, plain stitch kanoko, rib stitch, purl stitch, interlock stitch, Ponte di Roma, Milano rib or any of various modified textures, and these may be selected as appropriate for the purpose of the product.

The dyed yarn of the invention may be used for weft knitting (sweaters, etc.), circular knitting or weaving (outer or inner wear), lace, rib top or lapel accessories, braiding, chenille yarn, narrow tape, socks, supporter, pantstockings, tights, pile fabrics (outer wear, car sheets, etc.), carpets and the like.

The present invention will now be explained in greater detail by way of examples, with the understanding that these examples are in no way limitative on the invention.

The methods of measurement and evaluation were as follows.

(1) Reduction Viscosity (ηsp/c)

The polymer was dissolved in o-chlorophenol to a concentration of 1 g/dl at 90° C., and the obtained solution was transferred to a Ostwald viscosity tube and measured at 35° C. The following equation was used for calculation.

$$\eta sp/c=[(T/T0)-1]/C$$

(wherein T is the falling time of the solution sample (sec), T0 is the solvent falling time (sec) and C is the solution concentration (g/dl))

(2) Strength and Elongation

A Tensilon by Toyo-Baldwin Co., Ltd. was used for measurement of the tensile strength (cN/dtex), tensile elongation (%) and initial elastic modulus (cN/dtex) under conditions with a sample length of 20 cm and a pull rate of 20 cm/min. The elongation (%) under a load of 0.8826 cN/dtex was measured from a stress-strain curve.

(3) Boiling Water Shrinkage

This was measured according to boiling water shrinkage measurement method B of JIS-L-1013. The hot water temperature was 100° C.

(4) Crimp Elongation Factor

Dry heat treatment was carried out at 90° C. for 15 minutes in a Perfect Oven by Tabai Co., Ltd., under application of a load of $2.6\times10^{-4}$ cN/dtex, after which the yarn was allowed to stand for 24 hours and then measured according to stretchability test method A of JIS-L-1090.

(5) Number of Crimps

This was measured according to the crimp counting method of JIS-L-1015.

The number of crimps was examined in a 2.54 cm section under an initial load of 0.18 mN/dtex on the entire dyed yarn, and the crimps with a radius of 2 mm or greater were counted. The crimps were counted at 10 random points in the yarn length direction, and the average value was calculated.

(6) Elastic Recovery

The fiber was mounted in a tensile tester under an initial load of 0.0294 cN/dtex with a chuck distance of 20 cm, elongated to an elongation factor of 20% at a pull rate of 20 cm/min, and allowed to stand for 1 minute. It was then allowed to contract at the same rate, and a stress-strain curve was drawn. The residual elongation (A) was defined as the elongation at the point when the stress during contraction was 0.0294 cN/dtex.

The elastic recovery at 20% elongation was calculated by the following formula.

$$\text{Elastic recovery at 20\% elongation (\%)}=[(20-A)/20]\times100$$

The elastic recovery at 10% elongation was determined in the same manner as above, reading off the initial load and residual elongation, with 0.08826 cN/dtex as the stress and 10% as the maximum elongation factor, and it was calculated by the following formula.

$$\text{Elastic recovery at 10\% elongation (\%)}=[(10-A)/10]\times100$$

(7) Weft Knit Fabric Stretchability

This was measured according to the stretching elastic modulus measurement method A (constant stretching method) of JIS-L-1018.

Using an autograph-equipped constant rate tensile tester and a sample piece with a width of 10 cm and a length of 15 cm, application of an initial load of 2.942 cN was followed by elongation to an elongation factor of 100% at a rate of 10 cm/min, with a grip width of 2.5 cm and a grip distance of 10 cm, and then standing for 1 minute. The sample was then allowed to contract at the same rate, a stress-strain curve was drawn, and L (mm) was determined as the residual elongation at the point when the stress during contraction was equivalent to the stress with the initial load, for calculation of the recovery according to the following formula.

$$\text{Recovery (\%)}=[(100-L)/100]\times100$$

The stretchability of the obtained weft knit fabric was ranked on the following scale, based on the recovery.

◎: Recovery of >90%

○: Recovery of ≧85% and <90%

Δ: Recovery of ≧80% and <85%

X: Recovery of <70%

(8) Weft Knit Fabric Pliability, Bulkiness and Feel

An organoleptic examination was conducted based on touch by 10 examiners involved in fiber research, and the following ranking was made.

<Pliability>

○: Soft feel

Δ: Somewhat soft feel

X: Hard feel

<Weft Knit Fabric Bulkiness>

○: Definitely bulky

Δ: Bulky in some degree

X: Not bulky

<Feel>

○: Feel similar to cellulose-based fiber or wool fiber (Dryness, moisture absorption, drape quality)

Δ: Feel somewhat similar to cellulose-based fiber or wool fiber

X: Almost no feel similar to cellulose-based fiber (9) Dimensional Stability of Weft Knit Fabric This was measured according to the shrinkage measurement method D of JIS-L-1018, and the following ranking was made.

○: Warp and weft shrinkage within −3.0 to 5.0%

Δ: Warp or weft shrinkage outside of −3.0 to 5.0%

X: Both warp and weft shrinkage outside of −3.0 to 5.0%

EXAMPLE 1

Polytrimethylene terephthalate chips with an ηsp/c of 0.8 were used to obtain undrawn yarn at a spinning temperature of 265° C. and a spinning speed of 1200 m/min. The yarn was then draw twisted at a hot roll temperature of 60° C., a hot plate temperature of 140° C., a draw factor of 3 and a draw speed of 800 m/min to obtain produced yarn at 167 dtex/72 f.

The properties of the produced yarn were a strength of 3.5 cN/dtex, a elongation of 45%, an elastic modulus of 22 cN/dtex and an elastic recovery of 85% at 20% elongation.

The 167 dtex/72 f polytrimethylene terephthalate produced yarn was twisted at 1000 T/m with an Italy yarn twister to obtain yarn (0% crimp elongation).

A Soft Winder by Kamitsu Co., Ltd. was used to wind the obtained yarn around a paper tube with a diameter of 81 mm, to 1 kg with a winding density of 0.40 g/cm$^3$. The cheese was replaced onto a dyeing tube with an outer diameter of 69 mm (replacement rate: 14.8%) and set in a cheese dyeing machine (Small Cheese Dyer, product of Hisaka Works, Ltd.), after which Scouroll FC-250 (1 g/liter, product of Kao Corp.) was added, the temperature was raised from room temperature to 60° C. at a temperature elevating rate of 2° C./min, and scouring was carried out at 60° C. for 10 minutes at a flow rate of 40 liters/min.

After scouring, the yarn was dewatered and washed with water, 1% omf of a disperse dye (Dianix Blue AC-E) and 0.5 g/liter of a dispersing agent (Disper TL) were added and the pH was adjusted to 5 with acetic acid, after which the dye solution was circulated in and out at a flow rate of 40 liters/min, the temperature was raised to 120° C. at a temperature elevating rate of 2° C./min, and dyeing was carried out at 120° C. for 30 minutes. After dyeing, the yarn was dewatered and washed with water, the temperature was raised to 80° C. at a temperature elevating rate of 2° C./min, and reduction clearing was carried out at 80° C. for 20 minutes with 1 g/liter of sodium hydroxide, 1 g/liter of hydrosulfite and 1 g/liter of Sanmole RC-700 (Nicca Chemical Co.), at a flow rate of 40 liters/min.

After the reduction clearing, the solution was removed, neutralization washing was performed, 5% omf of a silicone-based softener (Ronsize K-22, product of Ippo Sha Co., Ltd.) was added and oiling treatment was carried out at 50° C. for 20 minutes. This was dewatered and dried to obtain dyed yarn. The dyed yarn had excellent dyeing uniformity in the inner and outer layers of the cheese, and exhibited the properties shown in Table 1.

A weft knitting machine (14 gauge, product of Koppo Co., Ltd.) was used to combine 3 yarns of the dyed yarn obtained above, and then a weft knit fabric with a 24-course, 20-wale plain stitch texture was prepared and steam finished using a Hoffman press (Kobe Press, product of Kobe Electric Industry Co., Ltd.) to complete the weft knit fabric.

As shown in Table 1, the obtained weft knit fabric had excellent stretchability and dimensional stability, with a soft feel.

EXAMPLE 2

The 167 dtex/72 f polytrimethylene terephthalate multifilament produced yarn obtained in Example 1 was subjected to false twisting using an IVF338 pin false twisting machine by Ishikawa Works, Ltd. under conditions with a yarn speed of 190 m/min, a twist number of 2280 T/m, a false twisting temperature of 170° C., a 1st feed of 0.0% and a take-up feed of 4.1%, to obtain yarn with a crimp elongation of 200%.

A Soft Winder by Kamitsu Co., Ltd. was used for direct winding of the obtained yarn around a dyeing tube with an outer diameter of 69 mm, to make a 1 kg cheese with a winding density of 0.25 g/cm$^3$. The cheese was subjected to cheese dyeing and finishing in the same manner as Example 1. The properties of the dyed yarn are shown in Table 1.

This dyed yarn was used to obtain a weft knit fabric in the same manner as Example 1. As shown in Table 1, the obtained weft knit fabric had excellent stretchability and dimensional stability, with a soft feel.

EXAMPLE 3

Polytrimethylene terephthalate multifilament produced yarn (84 dtex/36 f) was obtained in the same manner as Example 1. The properties of the produced yarn were a strength of 3.2 cN/dtex, a elongation of 46%, an elastic modulus of 24 cN/dtex and an elastic recovery of 85% at 20% elongation.

The obtained 84 dtex/36 f polytrimethylene terephthalate multifilament produced yarn was subjected to false twisting using an IVF338 pin false twisting machine by Ishikawa Works, Ltd. under conditions with a yarn speed of 190 m/min, a twist number of 3400 T/m, false twisting in the Z direction, a false twisting temperature of 170° C., a 1st feed of 0.0% and a take-up feed of 4.1%, after which it was twisted in the S direction using an Italy yarn twister to obtain yarn. The crimp elongation of the yarn was 156%.

The obtained yarn was used to prepare a hank with a hank length of 180 cm and a winding weight of 250 g using a reeling machine by Ishikawa Works, Ltd. The hank was subjected to dry heat relaxing treatment for 20 minutes at 80° C. using a hot air drier, and then it was stuffed and set into a package dyeing machine (product of Hisaka Works, Ltd.) and subjected to scouring at 60° C. for 10 minutes using Scouroll FC-250 (1 g/liter, product of Kao Corp.).

After scouring, the yarn was dewatered and washed with water, 1% omf of a disperse dye (Dianix Blue AC-E) and 0.5 g/liter of a dispersing agent (Disper TL) were added and dyeing was performed for 30 minutes at 110° C. in a bath with the pH adjusted to 5 with acetic acid. After dyeing, the yarn was dewatered and washed with water, and reduction clearing was carried out at 80° C. for 20 minutes with 1 g/liter of sodium hydroxide, 1 g/liter of hydrosulfite and 1 g/liter of Sanmole RC-700 (Nicca Chemical Co.). After the reduction clearing, the solution was removed, neutralization washing was performed, 5% omf of a silicone-based softener (Ronsize K-22, product of Ippo Sha Co., Ltd.) was added and oiling treatment was carried out at 50° C. for 20 minutes.

The dewatered and dried hank was wound up onto a cone with a winder to obtain dyed yarn. The dyed yarn exhibited the properties shown in Table 1.

A weft knitting machine (14 gauge, product of Koppo Co., Ltd.) was used to combine 6 yarns of the dyed yarn obtained above, and then a weft knit fabric with a plain stitch texture was prepared and steam finished using a Hoffman press (Kobe Press, product of Kobe Electric Industry Co., Ltd.) to complete the weft knit fabric.

As shown in Table 1, the obtained weft knit fabric had excellent stretchability, dimensional stability and bulkiness, with a soft feel.

EXAMPLE 4

Two types of 84 dtex/36 f polytrimethylene terephthalate multifilament false twisted yarn, one false twisted in the Z direction and one in the S direction, were obtained in the same manner as Example 3. The two types of false twisted yarn (Z-false twisted and S-false twisted) were doubled and twisted at 120 T/m in the S direction with an Italy yarn twister to obtain ply yarn. The crimp elongation of the yarn was 184%.

This yarn was used to obtain dyed yarn in the same manner as Example 3, except that the dyeing temperature was changed to 98° C. The properties of the dyed yarn are shown in Table 1.

Three yarns of the dyed yarn were combined to obtain a weft knit fabric in the same manner as Example 1. As shown in Table 1, the obtained weft knit fabric had excellent stretchability, dimensional stability and bulkiness, with a soft feel.

EXAMPLE 5

Polytrimethylene terephthalate multifilament produced yarn (167 dtex/48 f) was obtained in the same manner as Example 1. The properties of the produced yarn were a strength of 3.8 cN/dtex, a elongation of 46%, an elastic modulus of 23 cN/dtex and an elastic recovery of 88% at 20% elongation.

The obtained produced yarn was used to obtain two types of false twisted yarn, one false twisted in the S direction and one in the Z direction, in the same manner as Example 3, except that the number of false twists was changed to 2800 T/m. The obtained false twisted yarns (Z-false twisted and S-false twisted) were doubled and twisted at 100 T/m in the S direction with an Italy yarn twister, after which the twisted yarn was wound onto a collapsed paper tube and subjected to steam twist setting for 20 minutes in an autoclave at 110° C. to obtain ply yarn. The crimp elongation of the yarn was 78%.

The obtained yarn was used to prepare a hank in the same manner as Example 3, and the hank was subjected to scouring, dyeing, reduction clearing, oiling treatment and cone winding in the same manner as Example 3 using a spray type hank dyeing machine, to obtain dyed yarn. The properties of the dyed yarn are shown in Table 1.

The obtained dyed yarn was used to obtain a weft knit fabric in the same manner as Example 4. As shown in Table 1, the obtained weft knit fabric had excellent stretchability and dimensional stability and adequate bulk, with a soft feel.

EXAMPLE 6

The ply yarn obtained in Example 4 by doubling two types of 84 dtex/36 f polytrimethylene terephthalate multifilament false twisted yarn, one false twisted in the Z direction and one in the S direction, and twisted at 120 T/m in the S direction, was worked with a continuous bulking apparatus by Superba Co., under conditions with a yarn speed of 500 m/min, an overfeed ratio of 160%, a relaxing temperature of 90° C., and a cheese winding density of 0.15 g/cm$^3$ at 1 kg of winding onto a dyeing tube with a diameter of 69 mm, to obtain a cheese.

The cheese was subjected to cheese dyeing and finishing in the same manner as Example 1 to obtain dyed yarn. The properties of the dyed yarn are shown in Table 1.

The dyed yarn was used to obtain a weft knit fabric in the same manner as Example 4. As shown in Table 1, the obtained weft knit fabric had excellent stretchability, dimensional stability and bulk, with a soft feel.

COMPARATIVE EXAMPLE 1

Dyed yarn was obtained in the same manner as Example 1, except that 167 dtex/72 f polyethylene terephthalate produced yarn (strength: 3.9 cN/dtex, elongation: 35%, elastic modulus: 97 cN/dtex, elastic recovery at 20% elongation: 25%, crimp elongation: 0%; product of Asahi Kasei Corp.) was used instead of the 167 dtex/72 f polytrimethylene terephthalate multifilament produced yarn of Example 1, and the cheese dyeing temperature was changed to 130° C. The properties of the obtained dyed yarn are shown in Table 1.

The dyed yarn was used to obtain a weft knit fabric in the same manner as Example 1. As shown in Table 1, the obtained weft knit fabric had inferior stretchability and a hard feel.

COMPARATIVE EXAMPLE 2

Dyed yarn was obtained in the same manner as Example 1, except that 155 dtex/48 f nylon 66 produced yarn (strength: 4.2 cN/dtex, elongation: 36%, elastic modulus: 27 cN/dtex, elastic recovery at 20% elongation: 65%, crimp elongation: 0%; product of Asahi Kasei Corp.) was used instead of the 167 dtex/72 f polytrimethylene terephthalate multifilament produced yarn of Example 1, the dye for cheese dyeing was an acidic dye, and the dyeing temperature was changed to 110° C. The properties of the obtained dyed yarn are shown in Table 1.

The dyed yarn was used to obtain a weft knit fabric in the same manner as Example 1. As shown in Table 1, the obtained weft knit fabric had somewhat inferior dimensional stability and stretchability compared to Example 1.

COMPARATIVE EXAMPLE 3

False twisted and real twisted yarn was obtained in the same manner as Example 3, except that 84 dtex/36 f polyethylene terephthalate produced yarn (strength: 3.9 cN/dtex, elongation: 35%, elastic modulus: 97 cN/dtex, elastic recovery at 20% elongation: 25%; product of Asahi Kasei Corp.) was used instead of the 84 dtex/36 f polytrimethylene terephthalate multifilament produced yarn of Example 3, and the false twisting conditions were changed to a yarn speed of 190 m/min, a twist number of 3200 T/m, a Z false twisting direction, a false twisting temperature of 220° C., a 1st feed of 0.0% and a take-up feed of 4.1%. The crimp elongation of the obtained dyed yarn was 145%.

This yarn was used to obtain dyed yarn in the same manner as Example 3, except that the dyeing temperature was changed to 130° C. The properties of the dyed yarn are shown in Table 1.

The dyed yarn was used to obtain a weft knit fabric in the same manner as Example 3. As shown in Table 1, the obtained weft knit fabric had excellent dimensional stability and bulkiness, but inferior stretchability.

EXAMPLE 7

The 167 dtex/48 f polytrimethylene terephthalate multifilament produced yarn obtained in Example 5 and 110 dtex/75 f cupro multifilament produced yarn (Bemberg™, product of Asahi Kasei Corp.; 0.9% boiling water shrinkage) were air-interlaced with an air pressure of 1.6 kgf/cm$^3$, and then subjected to false twisting under conditions with a yarn speed of 100 m/min, a twist number of 1400 T/m, a false twisting temperature of 170° C., a 1st feed of 0.0% and a take-up feed of 4.0%, using an IVF338 pin false twisting machine by Ishikawa Works, Ltd. The false twisted yarn was then subjected to additional twisting at 300 T/m in the S direction, which was opposite to the false twisting direction. The yarn had a crimp elongation of 52%.

A Soft Winder by Kamitsu Co., Ltd. was used to wind the obtained yarn around a paper tube with a diameter of 90 mm, to 1 kg with a winding density of 0.33 g/cm$^3$, to obtain a cheese.

The cheese was replaced onto a dyeing tube with an outer diameter of 72 mm (replacement rate: 20%) and then scoured, disperse dyed and reduction washed in the same manner as Example 1. After the reduction clearing, the solution was removed, neutralization washing was performed, and dyeing was carried out for 45 minutes with a reactive dye (Sumifix Supra Blue BRF) while adding 50 g/liter of salt cake, circulating the dye solution in and out at a flow rate of 40 liters/min, raising the temperature to 60° C. at a temperature elevating rate of 2° C./min and adding 15 g/liter of sodium carbonate in portions at 60° C.

After dyeing, and then solution removal, water washing, soaping, fixing and water washing, 5% omf of a high melting point wax-based softener (Ronsize N-700, product of Ippo Sha Co., Ltd.) was added and oiling treatment was carried out at 50° C. for 20 minutes. This was dewatered and dried to obtain dyed yarn. The properties of the dyed yarn are shown in Table 1.

A weft knitting machine (14 gauge, product of Koppo Co., Ltd.) was used to combine 2 yarns of the dyed yarn obtained above, and then a weft knit fabric with a 24-course, 20-wale plain stitch texture was prepared and steam finished using a Hoffman press (Kobe Press, product of Kobe Electric Industry Co., Ltd.) to complete the weft knit fabric. As shown in Table 1, the obtained weft knit fabric was a superb product having excellent stretchability and dimensional stability, with the soft feel characteristic of cupro.

EXAMPLE 8

Polytrimethylene terephthalate multifilament produced yarn (56 dtex/24 f) was obtained in the same manner as Example 1. The properties of the produced yarn were a strength of 3.7 cN/dtex, a elongation of 44%, an elastic modulus of 23 cN/dtex and an elastic recovery of 86% at 20% elongation.

The obtained produced yarn was used to obtain false twisted yarn in the same manner as Example 2, except that the number of false twists was changed to 3780 T/m.

This false twisted yarn and 110 dtex/40 f viscose rayon multifilament (Silmax™, product of Asahi Kasei Corp.; 2.0% boiling water shrinkage) were twisted at 800 T/m in the Z direction with an Italy yarn twister to obtain composite twisted yarn. Two yarns of this composite twisted yarn were then twisted at 580 T/m in the S direction with an Italy yarn twister to complete the yarn. The crimp elongation of the obtained yarn was 35%.

The yarn was formed into a hank and relaxed in the same manner as Example 3, after which a spray type hank dyeing machine (product of Sinko Co.) was used for dyeing at 95° C. for 45 minutes with the same disperse dye used in Example 1, reduction clearing and water washing were carried out, dyeing was performed at 60° C. for 45 minutes with the same reactive dye used in Example 7, and then soaping, fixing and oiling treatment were carried out to obtain dyed yarn. The properties of the dyed yarn are shown in Table 1.

This dyed yarn was used to obtain a weft knit fabric in the same manner as Example 5. As shown in Table 1, the obtained weft knit fabric was a superb product having excellent stretchability and dimensional stability, with the soft feel characteristic of viscose rayon.

EXAMPLE 9

With the 167 dtex/48 f polytrimethylene terephthalate multifilament false twisted yarn obtained in Example 5 as core yarn, a covering machine was used for double covering with a 60 count (English cotton count) cotton yarn (first covering: S twisting, 800 T/m; second covering real twisting: Z twisting, 650 T/m), to obtain yarn. The crimp elongation of the obtained yarn was 80%.

The yarn was subjected to hank dyeing in the same manner as Example 8 to obtain dyed yarn. The properties of the dyed yarn are shown in Table 1.

This dyed yarn was used to obtain a weft knit fabric in the same manner as Example 5. As shown in Table 1, the obtained weft knit fabric was a superb product having excellent stretchability and dimensional stability, with the soft feel characteristic of cotton.

EXAMPLE 10

Double covered yarn was obtained in the same manner as Example 9, except that the core yarn was changed to 60 count (wool count) wool fiber and the covering yarn was changed to the 84 dtex/36 f polytrimethylene terephthalate multifilament false twisted yarn obtained in Example 3. The crimp elongation of the obtained yarn was 10%.

This yarn was used to obtain a weft knit fabric in the same manner as Example 5. As shown in Table 1, the obtained weft knit fabric was a superb product having excellent stretchability and dimensional stability, with the soft feel characteristic of wool.

COMPARATIVE EXAMPLE 4

Dyed yarn was obtained in the same manner as Example 7, except that 167 dtex/48 f polyethylene terephthalate produced yarn such as used in Comparative Example 1 was used instead of the 167 dtex/48 f polytrimethylene terephthalate multifilament produced yarn in Example 7. The properties of the obtained dyed yarn are shown in Table 1.

The dyed yarn was used to obtain a weft knit fabric in the same manner as Example 7. As shown in Table 1, the obtained weft knit fabric had satisfactory dimensional stability but poor stretchability and a hard feel, while the characteristic feel and luster of Bemberg were not exhibited.

COMPARATIVE EXAMPLE 5

Dyed yarn was obtained in the same manner as Example 7, except that 155 dtex/48 f nylon 66 produced yarn such as used in Comparative Example 2 was used instead of the 167 dtex/48 f polytrimethylene terephthalate multifilament produced yarn in Example 7, the disperse dye was changed to an acidic dye, and the dyeing temperature was changed to 110° C. The properties of the obtained dyed yarn are shown in Table 1.

The dyed yarn was used to obtain a weft knit fabric in the same manner as Example 7. As shown in Table 1, the obtained weft knit fabric had inferior dimensional stability and stretchability, as well as a hard feel, while the characteristic feel and luster of Bemberg were not exhibited.

COMPARATIVE EXAMPLE 6

False twisted yarn was obtained in the same manner as Example 2, except that 167 dtex/50 f viscose rayon multifilament produced yarn (Silmax™, product of Asahi Kasei Corp.; 2.1% boiling water shrinkage) was used instead of the 167 dtex/72 f polytrimethylene terephthalate multifilament produced yarn in Example 2. The crimp elongation of the obtained yarn was 7%.

This yarn was used to obtain dyed yarn in the same manner as Example 7, except that no disperse dye dyeing or reduction clearing were performed. The properties of the obtained dyed yarn are shown in Table 1.

The dyed yarn was used to obtain a weft knit fabric in the same manner as Example 2. As shown in Table 1, the obtained weft knit fabric had inferior stretchability and dimensional stability.

COMPARATIVE EXAMPLE 7

Dyed yarn was obtained in the same manner as Example 1, except that the cheese winding conditions in Example 1 were changed to a winding density of 0.55 g/cm$^3$ on a dyeing tube with a diameter of 69 mm, and no replacement was carried out. The dyed yarn exhibited dyeing spots in the inner and outer layers of the cheese. The properties of the yarn are shown in Table 1.

This dyed yarn was used to obtain a weft knit fabric in the same manner as Example 1. As shown in Table 1, the obtained weft knit fabric had a dyed yarn boiling water shrinkage of 4.5%, and the dimensional stability of the weft knit fabric was inferior.

TABLE 1

| | Dyed yarn properties | | | | | Weft knit fabric properties | | | | |
|---|---|---|---|---|---|---|---|---|---|---|
| | Elastic recovery under 10% elongation (%) | Crimping elongation (%) | Elongation under constant load (%) | Boiling water shrinkage (%) | No. of crimps | Stretchability | Dimensional stability | Pliability | Bulkiness | Feel |
| Example 1 | 84 | 1.1 | 10.0 | 1.5 | 0 | ◎ | ○ | ○ | x | — |
| Example 2 | 85 | 1.3 | 10.5 | 1.7 | 0 | ◎ | ○ | ○ | x | — |
| Example 3 | 82 | 91 | 11.0 | 0.6 | 0 | ◎ | ○ | ○ | ○ | — |
| Example 4 | 86 | 120 | 11.3 | 0.9 | 1 | ◎ | ○ | ○ | ○ | — |
| Example 5 | 84 | 24 | 10.1 | 0.7 | 0 | ○ | ○ | ○ | Δ | — |
| Example 6 | 80 | 66 | 10.7 | 0.5 | 0 | ○ | ○ | ○ | ○ | — |
| Comp.Ex. 1 | 30 | 0.5 | 4.5 | 0.6 | 0 | x | ○ | x | x | — |
| Comp.Ex. 2 | 50 | 0.8 | 7.0 | 1.7 | 0 | Δ | Δ | Δ | x | — |
| Comp.Ex. 3 | 29 | 75 | 8.5 | 0.5 | 1 | Δ | ○ | x | ○ | — |
| Example 7 | 80 | 25 | 13.3 | 1.0 | 0 | ○ | ○ | ○ | Δ | ○ |
| Example 8 | 82 | 30 | 19 | 1.3 | 0 | ◎ | ○ | ○ | Δ | ○ |
| Example 9 | 73 | 19 | 23 | 1.9 | 0 | ○ | ○ | ○ | ○ | ○ |
| Example 10 | 87 | 10 | 18 | 1.5 | 0 | ○ | ○ | ○ | Δ | ○ |
| Comp.Ex. 4 | 45 | 12 | 6.5 | 1.0 | 0 | x | ○ | x | x | x |
| Comp.Ex. 5 | 55 | 15 | 6.8 | 2.5 | 0 | Δ | Δ | Δ | x | x |
| Comp.Ex. 6 | 13 | 3 | 6.2 | 3.7 | 0 | x | x | Δ | x | ○ |
| Comp.Ex. 7 | 85 | 0.5 | 7.2 | 4.5 | 0 | ○ | x | ○ | x | — |

Note: The elongation under constant load was elongation under a load of 0.8826 cN/dtex.

Industrial Applicability

The dyed yarn of the present invention is dyed yarn with excellent stretchability and dimensional stability, as well as a soft feel, and it is therefore suitable for use in fabrics. In particular, because of the high crimp elongation of the yarn when crimped, it can form fabrics with excellent bulkiness. Its use in mixed yarns with cellulose-based fiber or wool fiber can effectively utilize the feel of the cellulose-based fiber or wool fiber, thereby allowing creation of fabrics with excellent stretchability and feel.

What is claimed is:

1. Dyed yarn comprising crimped, dyed yarn containing dyed polytrimethylene terephthalate fiber, said yarn having an elastic recovery of 60% or greater under 10% elongation, a boiling water shrinkage of no greater than 4% and a crimp elongation of 10% or greater.

2. Dyed yarn according to claim 1 wherein said crimped, dyed yarn is composed of polytrimethylene terephthalate fiber and a fiber other than polytrimethylene terephthalate fiber.

3. Dyed yarn according to claim 2, wherein the fiber other than polytrimethylene terephthalate fiber is cellulose-based fiber or wool fiber.

4. Dyed yarn according to any one of claims 1, 2, or 3 wherein said crimped, dyed yarn has an elongation of 5% or greater under a load of 0.8826 cN/dtex.

* * * * *